US009682753B1

(12) United States Patent
Kato et al.

(10) Patent No.: US 9,682,753 B1
(45) Date of Patent: Jun. 20, 2017

(54) STAND-UP TYPE PERSONAL WATERCRAFT

(71) Applicant: KAWASAKI JUKOGYO KABUSHIKI KAISHA, Kobe-shi, Hyogo (JP)

(72) Inventors: Hironori Kato, Kakogawa (JP); Toshio Araki, Kakogawa (JP); Minoru Kanamori, Rowland Heights, CA (US); Tadao Minesaki, Kobe (JP)

(73) Assignee: Kawasaki Jukogyo Kabushiki Kaisha, Kobe-shi, Hyogo (JP)

( * ) Notice: Subject to any disclaimer, the term of this patent is extended or adjusted under 35 U.S.C. 154(b) by 0 days.

(21) Appl. No.: 15/004,120

(22) Filed: Jan. 22, 2016

(51) Int. Cl.
*B63H 21/32* (2006.01)
*B63B 35/73* (2006.01)

(52) U.S. Cl.
CPC ..... *B63B 35/731* (2013.01); *B63H 21/32* (2013.01); *F01N 2590/022* (2013.01)

(58) Field of Classification Search
CPC ... B63B 35/731; B63B 35/7943; B63H 21/32; B63H 21/34; B63H 20/245; F01N 2590/022
USPC ..... 114/55.56
See application file for complete search history.

(56) References Cited

U.S. PATENT DOCUMENTS 6,997,128 B2 * 2/2006 Matsuda ..... B63H 21/24 114/55.52
7,117,806 B2 * 10/2006 Kamio ..... B63B 11/02 114/183 R

* cited by examiner

*Primary Examiner* — Andrew Polay
(74) *Attorney, Agent, or Firm* — Alleman Hall Creasman & Tuttle LLP

(57) ABSTRACT

A stand-up type personal watercraft comprises a body including a deck and a hull; a standing deck which is provided at a rear part of the deck and on which a rider stands; and a pair of deck fins located on a left side and a right side of the standing deck, respectively, protruding upward, and extending in a forward and rearward direction, wherein the standing deck has a substantially rectangular shape when viewed from above.

4 Claims, 4 Drawing Sheets

STAND-UP TYPE PERSONAL WATERCRAFT

BACKGROUND OF THE INVENTION

Field of the Invention

The present invention relates to a stand-up type personal watercraft.

Description of Related Art

A stand-up type personal watercraft is disclosed in, for example, U.S. Pat. No. 7,117,806. The stand-up type personal watercraft includes a standing deck provided at the rear part of a deck of a body, and deck fins protruding upward from the right and left sides of the standing deck. In a typical steering posture, a rider stands on the standing deck, opens their feet to the front and to the rear, respectively, and grips a steering handle in front of them with their right and left hands. The rider rotates the steering handle to turn the personal watercraft. In this case, the foot (left foot in the case of a turn to the left) on a side to which the body of the personal watercraft is to be turned is located on the front side, and by applying the weight of the rider to the foot located on the front side, the personal watercraft can make a quick turn while planing on the water. The rider opens the foot located on the front side to the side to which the body of the personal watercraft is turned, leans the leg of the foot located on the front side against the deck fin, and applies a force to the edge of the standing deck with the foot located on the front side. Thereby, the body of the personal watercraft can be banked to the side to which the body of the personal watercraft is turned. In this way, a quick movement can take place.

The front portion of the standing deck has a width in a rightward and leftward direction which is smaller than that of the rear portion of the standing deck. For this reason, it is difficult for the rider to smoothly reverse the foot located on the front side and the foot located on the rear side. The rider is required to have a skill to make a quick turn. In addition, a region in a rightward and leftward direction in which the foot located on the front side is movable is narrow, and the rider cannot widely open the foot located on the front side to the side to which the body of the personal watercraft is turned. To bank the body of the watercraft, the rider is required to significantly tilt the upper half part of the rider's body so that their weight is applied to the deck fin. In this respect also, the rider is required to have a skill to make a quick turn.

SUMMARY OF THE INVENTION

An object of the present invention is to provide a stand-up type personal watercraft which can easily make a quick turn.

According to an aspect of the present invention, a stand-up type personal watercraft comprises a body including a deck and a hull; a standing deck which is provided at a rear part of the deck and on which a rider stands; and a pair of deck fins located on a left side and a right side of the standing deck, respectively, protruding upward, and extending in a forward and rearward direction, wherein the standing deck has a substantially rectangular shape when viewed from above.

In accordance with this configuration, the width of the front portion of the standing deck in a rightward and leftward direction is great and substantially equal to the width of the rear portion of the standing deck in the rightward and leftward direction. Therefore, the rider can smoothly reverse which foot is located on a front side and which foot is located on a rear side. In addition, a region in the rightward and leftward direction in which the foot located on the front side is movable can be increased. Therefore, the rider can widely open the foot located on the front side to the side to which the body of the personal watercraft is turned. As a result, the rider can easily make a quick turn.

DETAILED DESCRIPTION OF THE PREFERRED EMBODIMENTS

Hereinafter, the embodiment will be described with reference to the drawings. The stated directions are from the perspective of a rider riding in a personal watercraft 1.

Figure 1:
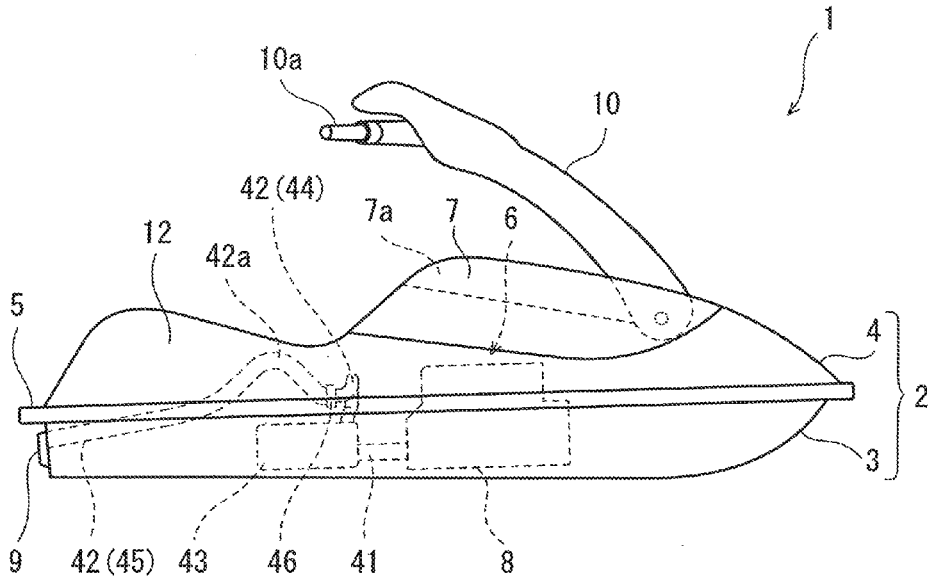
FIG. 1 is a side view of a personal watercraft according to an embodiment.
Figure 2:
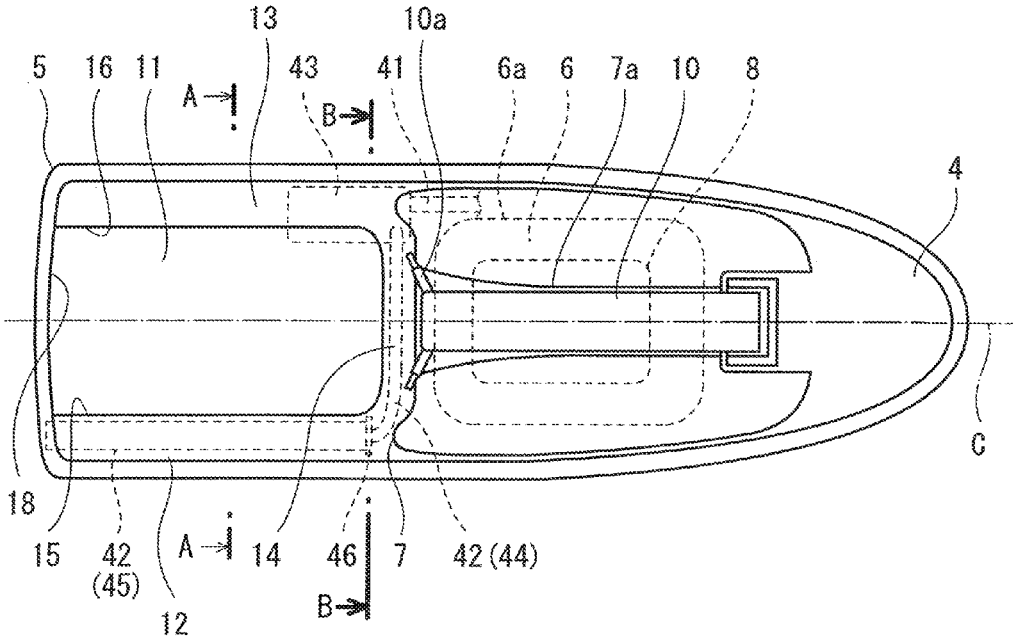
FIG. 2 is a plan view of the personal watercraft according to the embodiment.

As shown in FIGS. 1 and 2, the personal watercraft 1 includes a body 2 including a hull 3 and a deck 4. The deck 4 covers the hull 3 from above, and is connected to the hull 3. A connection line of the hull 3 and the deck 4 is in some cases called a gunnel line 5. An engine room 6 is provided in the interior of the body 2, is in communication with a maintenance opening 6*a* provided in the deck 4, and is opened upward through the maintenance opening 6*a*. An engine hood 7 covers the maintenance opening 6*a* from above, and is detachably attached to the deck 4. An engine 8 is disposed in the engine room 6. A water jet pump (not shown) is driven by the output shaft of the engine 8. The water jet pump pressurizes and accelerates water suctioned through a suction port provided in the hull 3. The pressurized and accelerated water is ejected rearward through a jet nozzle 9 attached to the rear end portion of the body 2. In this way, a forward propulsive force is generated in the body 2.

The personal watercraft 1 is a stand-up type personal watercraft which is steered by the rider in a standing posture. A standing deck 11, and right and left deck fins 12, 13 are provided at the rear portion of the deck 4. The standing deck 11 is located rearward relative to the engine room 6. The floor surface of the standing deck 11 is set to be lower than the upper end of the engine room 6. The standing deck 11 has, on the front side thereof, a front wall 14 protruding upward and extending in a rightward and leftward direction. The standing deck 11 is isolated from the engine room 6 by the front wall 14. The right and left deck fins 12, 13 are provided on the right side and the left side of the standing deck 11, respectively, to protrude upward and extend in a forward and rearward direction. The front end portions of the right and left deck fins 12, 13 are continuous with the front wall 14. The rear portion of the standing deck 11 is not surrounded by the deck fins 12, 13 and a wall such as the front wall 14, and is opened rearward so that the rider can easily get on and off the personal watercraft 1.

A right edge 15 of the standing deck 11 is continuous with the lower end of the inner side surface of the right deck fin 12. A left edge 16 of the standing deck 11 is continuous with the lower end of the inner side surface of the left deck fin 13.

The right edge 15 and the left edge 16 extend in the forward and rearward direction. A front edge 17 of the standing deck 11 is continuous with the lower end of the rear surface of the front wall 14 and extends in the rightward and leftward direction. The right end of the front edge 17 is continuous with the front end of the right edge 15, while the left end of the front edge 17 is continuous with the front end of the left edge 16. The standing deck 11 is surrounded by the right and left deck fins 12, 13, and the front wall 14, which have a U-shape when viewed from above. When viewed from above, the standing deck 11 has a rectangular shape which is symmetric in the rightward and leftward direction with respect to a center line C of the body 2 in the rightward and leftward direction.

The front end portion of a handle pole 10 is coupled to the upper surface of the deck 4 in front of the maintenance opening 6*a* in such a manner that the handle pole 10 is rotatable around the front end portion. The handle pole 10 is vertically pivotable around the front end portion thereof. A bar-type steering handle 10*a* is attached on the rear end portion of the handle pole 10. A groove 7*a* extending in the forward and rearward direction is provided in the center portion, in the rightward and leftward direction, of the upper surface of an engine hood 7. The handle pole 10 is accommodated in the groove 7*a* in a state in which the steering handle 10*a* is not gripped by the rider. The rider stands on the standing deck 11, grips the steering handle 10*a*, and moves the handle pole 10 upward. In this state, the rider steers the personal watercraft 1.

When the rider rotates the steering handle 10*a* to the right, the direction in which the water is ejected from the jet nozzle 9 is inclined to the right. Thereby, a rightward propulsive force is generated in the body 2, and the personal watercraft 1 can be turned to the right. At this time, the rider tilts (rolls or banks) the body 2 to the right, and can make a quick turn. In other words, the personal watercraft 1 can be turned at a high speed with a small turn radius.

The body 2 can be tilted by appropriately changing the posture of the rider's body. In a case where the rider turns the body 2 to the right, the rider moves their right foot to the front on the standing deck 11. The rider opens their right foot to the right, engages their right foot with the right edge 15 of the standing deck 11, and leans their right leg against the inner side surface of the right deck fin 12. The rider transfers their body weight to the right deck fin 12 through their right leg (and leans the upper half part of their body to the right, if necessary) to apply a rightward force to the right deck fin 12. In this way, the body 2 is tilted to the right. In a case where the rider turns the body 2 to the left, the foot located on the front side and the foot located on the rear side are reversed between the right foot and the left foot, in the above-described procedure. The rider moves their left foot to the front, opens their left foot to the left, engages the left foot with the left edge 16 of the standing deck 11, and leans their left leg against the inner side surface of the left deck fin 13.

Conventionally, in general, the standing deck 11 has an isosceles trapezoid shape when viewed from above. The right edge 15 and the left edge 16 are inclined with respect to the forward and rearward direction in such a manner that the right edge 15 and the left edge 16 are close to each other in the rightward and leftward direction, as the right edge 15 and the left edge 16 extend in a forward direction. The front portion of the standing deck 11 has a width in the rightward and leftward direction which is smaller than that of the rear portion of the standing deck 11.

Figure 3:
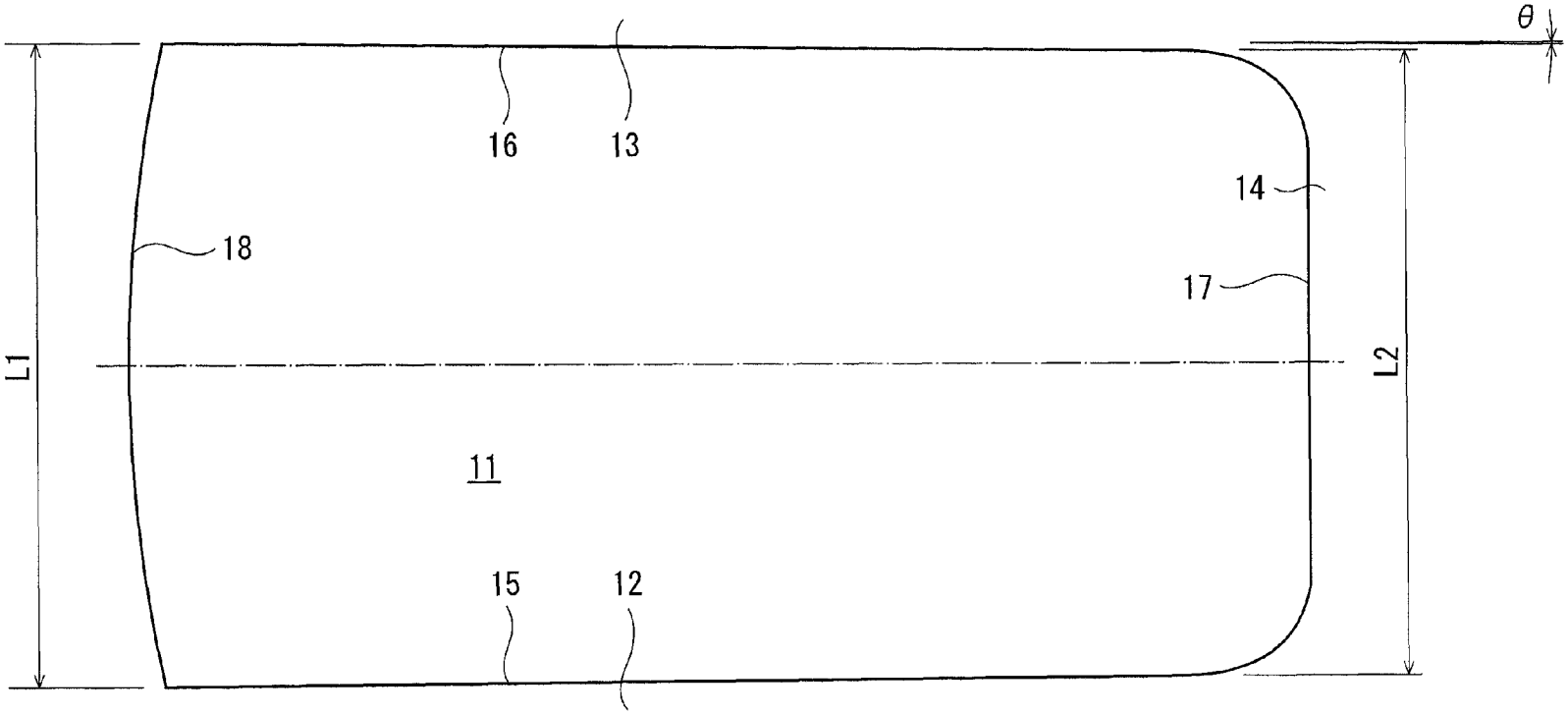
FIG. 3 is a plan view of a standing deck.

In contrast, as shown in FIG. 3, in the present embodiment, the standing deck 11 has the substantially rectangular shape when viewed from above. The right edge 15 and the left edge 16 of the standing deck 11 extend substantially in parallel and are not substantially inclined with respect to the forward and rearward direction.

In the present embodiment, a width L2 in the rightward and leftward direction of the front portion of the standing deck 11 is great and substantially equal to a width L1 in the rightward and leftward direction of the rear portion of the standing deck 11. In this configuration, the rider can smoothly reverse the foot located on the front side and the foot located on the rear side. In addition, the size of the region in the rightward and leftward direction in which the foot located on the front side is movable can be increased. Therefore, the foot located on the front side can be widely opened to the side to which the body 2 of the personal watercraft is turned. When a rightward force is applied to the deck fin 12, 13, a roll moment exerted on the body 2 can be increased, and the body 2 can be easily tilted. As a result, the rider can easily perform a quick turn operation.

For example, an inclination angle θ of the left edge 16 of the standing deck 11 with respect to the center line C of the body 2 in the rightward and leftward direction is equal to or less than 1.0 degrees. The right edge 15 has an equal inclination angle θ. A ratio of the width L2 in the rightward and leftward direction, of the front portion of the standing deck 11, with respect to the width L1 in the rightward and leftward direction, of the rear portion 18 of the standing deck 11, is equal to or greater than 0.9. Alternatively, the width L2 in the rightward and leftward direction, of the front portion of the standing deck 11 may be greater than the width L1 in the rightward and leftward direction, of the rear portion of the standing deck 11. The standing deck 11 may have an isosceles trapezoid shape in which the rear portion of the standing deck 11 is made narrower, when viewed from above.

Figure 4:
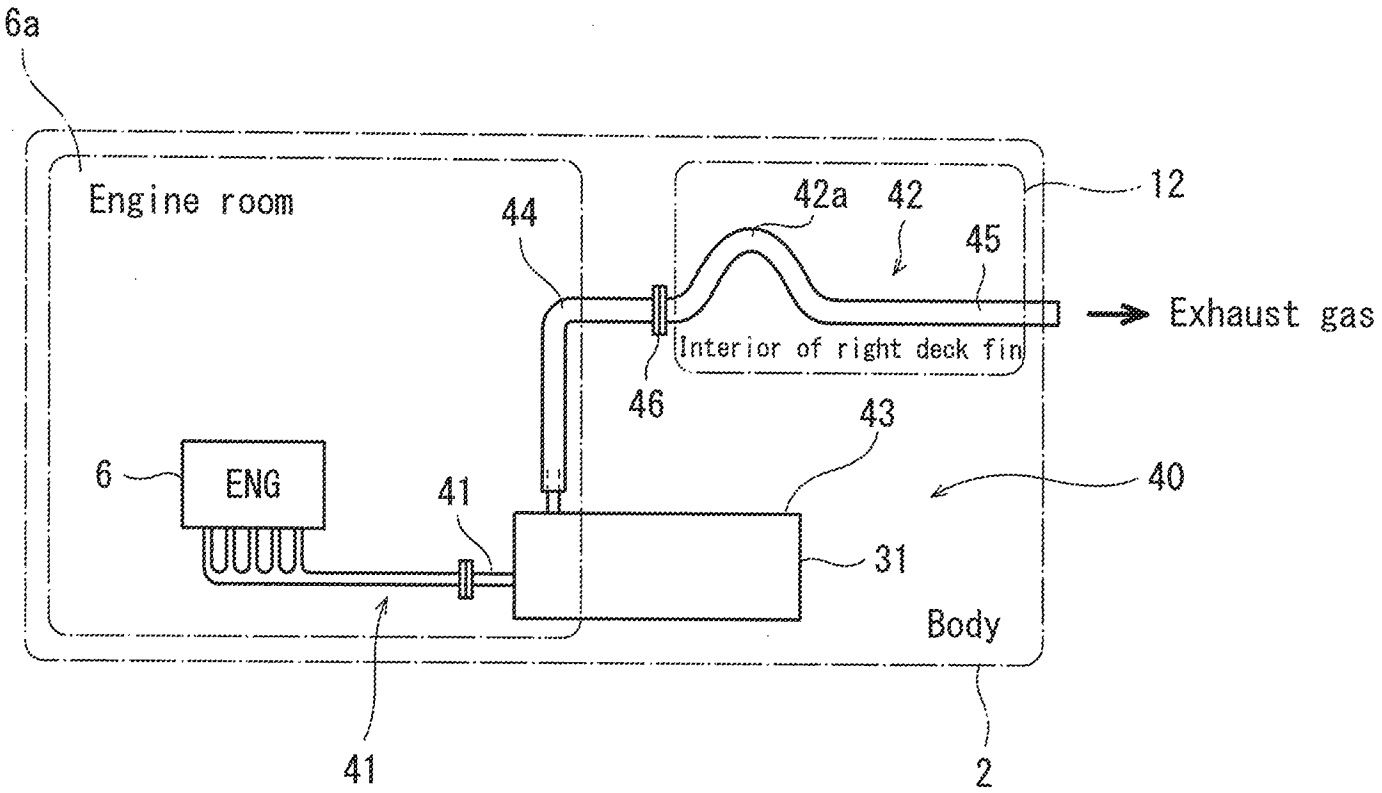
FIG. 4 is a view schematically showing the configuration of an exhaust system of the personal watercraft.

FIG. 4 is a view showing the configuration of an exhaust system 40. The exhaust system 40 includes a first exhaust pipe 41, a water muffler 43, and a second exhaust pipe 42. The first exhaust pipe 41 serves to guide an exhaust gas emitted from the engine 8 to the water muffler 43. The first exhaust pipe 41 is placed between the exhaust port of the engine 8 and the water muffler 43. The second exhaust pipe 42 serves to guide the exhaust gas which has flowed through the water muffler 43 to the outside of the watercraft. The upstream end portion of the second exhaust pipe 42 is connected to the outlet pipe of the water muffler 43. The downstream end portion of the second exhaust pipe 42 is opened at the stern.

The second exhaust pipe 42 includes a plurality of pipe members which are connected to each other. For example, the second exhaust pipe 42 includes an upstream member 44 connected to the water muffler 43, and a downstream member 45 which is opened at the stern. The downstream end portion of the upstream member 44 is connected to the upstream end portion of the downstream member 45 via a clamp member 46. The downstream member 45 is accommodated in the inner space of the right deck fin 12 and extends in the forward and rearward direction. The water muffler 43 is placed below the left deck fin 13 on an opposite side of the right deck fin 12 in which the downstream member 45 is accommodated. The upstream member 44 extends in the rightward and leftward direction in the rear portion of the engine room 6, and is placed between the water muffler 43 and the downstream member 45, which are placed on opposite sides in the rightward and leftward direction. Since the second exhaust pipe 42 has a portion extending in the rightward and leftward direction in the interior of the body 2 as described above, it becomes possible to prevent a situation in which the water surrounding the personal watercraft 1 flows back through the exhaust pipe and reaches the water muffler 43 and hence the engine 8, even when the body 2 rolls over to the left or to the right. The second exhaust pipe 42 includes a swelling portion 42*a* which has a convex shape curving upward or an inverted V-shape in the interior of the deck fin 13. Since the second exhaust pipe 42 includes the swelling portion 42*a*, it becomes possible to prevent a situation in which the water reaches a region which is upstream of the swelling portion 42*a*, namely, the water muffler 43 and hence the engine 8, even if the water surrounding the personal watercraft 1 flows back through the exhaust pipe. For example, the downstream member 45 is made of metal. Alternatively, the downstream member 45 may be made of rubber so that the upstream member 44 can be easily laid out in the rear portion of the narrow engine room 6, and the upstream member 44 can be easily connected to the water muffler 43 and the downstream member 45.

Figure 5A:
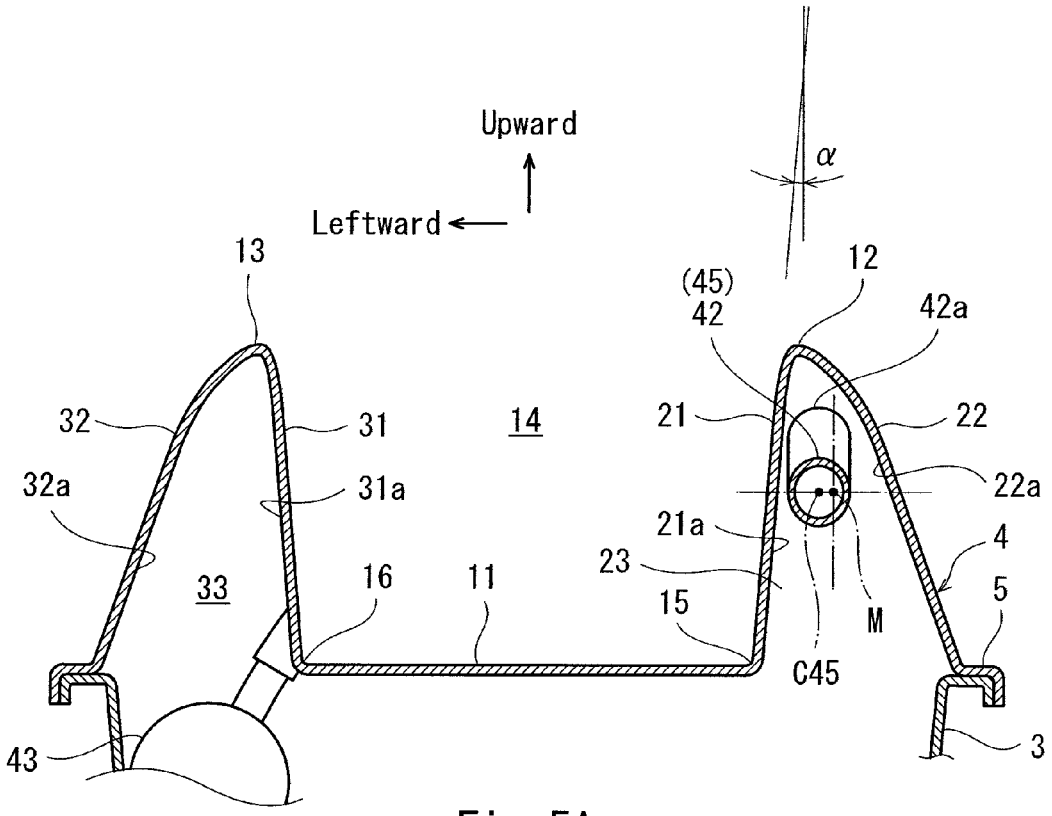
FIG. 5A is a cross-sectional view of a deck which is taken along line A-A of FIG. 2.
Figure 5B:
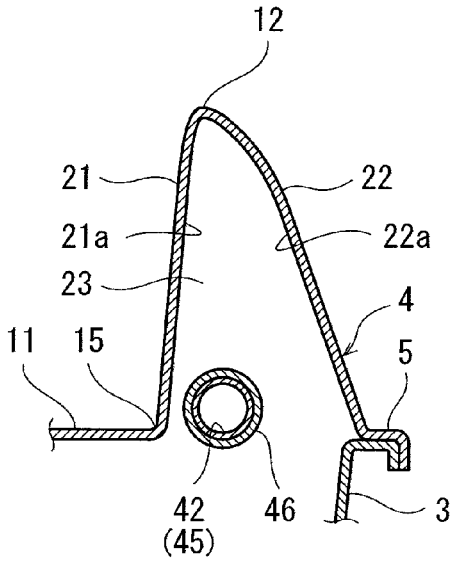
FIG. 5B is a cross-sectional view of the deck which is taken along line B-B of FIG. 2.

FIG. 5A is a cross-sectional view of the deck which is taken along line A-A of FIG. 2. FIG. 5B is a cross-sectional view of the deck which is taken along line B-B of FIG. 2. As shown in FIGS. 5A and 5B, the right deck fin 12 includes an inner side wall 21 protruding upward on an inner side (left side in this case) in the rightward and leftward direction, and an outer side wall 22 protruding upward on an outer side (right side in this case) in the rightward and leftward direction. The gunnel line 5 is formed at the lower end of the outer side wall 22. The right deck fin 12 includes an inner space 23 surrounded by the inner side wall 21 and the outer side wall 22. As in the right deck fin 12, the left deck fin 13 includes an inner side wall 31, an outer side wall 32, and an inner space 33. Since the left deck fin 13 is symmetric with the right deck fin 12 in the rightward and leftward direction, the same structure as that of the right deck fin 12 will not be described repeatedly.

The inner side wall 21 and the outer side wall 22 are inclined to the right and the left, respectively, to be close to each other, as the inner side wall 21 and the outer side wall 22 extend in an upward direction. In this structure, when viewed from the front or from the rear, the cross-sectional shape of the deck fin 12 has a convex shape curving upward. In a case where the deck 4 is integrally molded using a resin, it is necessary to consider a draft angle. In view of this, it is necessary to make the inner side wall 21 and the outer side wall 22 inclined as described above.

In the present embodiment, the inner side wall 21 is inclined at a smaller angle in the rightward and leftward direction than the outer side wall 22 is. In other words, the inner side wall 21 extends upward steeply at a greater angle than the outer side wall 22 does. For the purpose of easier manufacturing, the draft angle of the inner side wall 21 can be made as small as possible. This makes it possible to locate the right edge of the standing deck 11 to an outermost side in the rightward and leftward direction, which can increase the width of the standing deck 11. Since the inner side wall 21 extends upward steeply, the weight of the rider can be easily applied to the deck fin 12 without significantly lowering the upper half of the rider's body, when the leg located on the front side is leaned against the inner side wall 21. Therefore, the rider can easily make a quick turn. For example, the inclination angle (a draft angle $\alpha$ on the inner side of the deck fin 12) of the outer surface of the inner side wall 21 with respect to a vertical direction is equal to or greater than 1.5 degrees and less than 4.0 degrees.

The exhaust pipe is accommodated in the inner space 23 of the right deck fin 12. In the present embodiment, the second exhaust pipe 42, to be precise, the downstream member is accommodated in the inner space 23 of the right deck fin 12. The exhaust pipe (downstream member 45) is made closer to the inner surface 21*a* of the inner side wall 21 rather than the inner surface 22*a* of the outer side wall 22. In other words, the center C45 of the exhaust pipe is made closer to the inner side wall 21 than a middle point M is, the middle point M being of a line segment extending through the center C45 of the exhaust pipe and connecting the inner surface 21*a* of the inner side wall 21 to the inner surface 22*a* of the outer side wall 22. The deck fin 12, 13 has an inner space surrounded by the inner surface 21*a*, 31*a* of the inner side wall 21, 31 and the inner surface 22*a*, 32*a* of the outer side wall 22, 32. The exhaust pipe is accommodated in the inner space 23 of the right deck fin 12. The exhaust pipe is made closer to the inner surface 21*a* of the inner side wall 21 of the right deck fin 12 rather than the inner surface 22*a* of the outer side wall 22 of the right deck fin 12. In other words, the center C45 of the exhaust pipe is located on the inner side in the rightward and leftward direction with respect to a virtual line extending vertically through the top point of the deck fin 12. Since the inner side wall 21 extends upward steeply, the exhaust pipe can be placed to be closer to the inner side wall 21.

The downstream member 45 of the second exhaust pipe 42 is accommodated in the right deck fin 12. The downstream member 45 has the above-described swelling portion 42*a*. The front end portion of the downstream member 45 is located below and in front of the top point of the swelling portion 42*a*. As described above, the front end portion of the downstream member 45 is connected to the downstream end portion (the left end portion in the present embodiment) of the upstream member 44 via the clamp member 46. The clamp member 46 is located below and apart from the top point of the deck fin 12, 13. The inner side wall and the outer side wall of the deck fin 12, 13 are inclined to be made close to each other in the rightward and leftward direction. The deck fin 12, 13 has a cross-section which has a convex shape curving upward, when viewed from the front or the rear. If the clamp is located in the vicinity of the top point of the swelling portion for preventing the back flow, the upper portion of the deck fin is required to have a sufficient width in the rightward and leftward direction to accommodate the clamp therein, which increases the width of the lower portion of the deck fin in the rightward and leftward direction. The lower end of the inner side wall is located on the inner side in the rightward and leftward direction, and the width of the standing deck 11 is reduced. Since the downstream member includes the swelling portion and the clamp member is located below the top point of the swelling portion, the top point of the swelling portion can be located in the narrow upper portion and the clamp member can be placed in the lower portion of the deck fin, having an increased width in the rightward and leftward direction. This makes it possible to increase the width of the standing deck 11, in particular, the width of the front portion of the standing deck 11. In this way, the standing deck 11 can be formed to have the rectangular shape with a great width when viewed from above.

Although the embodiment has been described above, the above-described configuration can be suitably added to, deleted from, or changed within the scope of the present invention. Although the downstream member 45 of the second exhaust pipe 42 is accommodated in the deck fin 12, it is sufficient that the downstream member 45 may be accommodated in one of the right and left deck fins. In a case where the downstream member 45 of the second exhaust pipe 42 is accommodated in the right deck fin 12, the water muffler 43 is preferably placed below the left deck fin 13 which is on the opposite side of the right deck fin 12, to prevent the back flow of the water which may take place when the body of the watercraft is capsized.

The invention claimed is:

1. A stand-up type personal watercraft comprising:

a body including a deck and a hull;

a standing deck which is provided at a rear part of the deck and on which a rider stands;

a pair of deck fins located on a left side and a right side of the standing deck, respectively, protruding upward, and extending in a forward and rearward direction, one of the pair of deck fins having an inner space which is surrounded by an inner surface of an inner side wall and an inner surface of an outer side wall and accommodates a second exhaust pipe therein; and a clamp member which is provided on an outer side of an upstream end portion of the second exhaust pipe and retains a state in which the upstream end portion of the second exhaust pipe is connected to a first exhaust pipe extending from an engine, wherein the standing deck has a substantially rectangular shape when viewed from above, and wherein the second exhaust pipe extends in the forward and rearward direction in such a manner that the second exhaust pipe has a convex shape curving upward, and the upstream end portion of the second exhaust pipe and the clamp member are located in front of and below a top point of the second exhaust pipe.

2. The stand-up type personal watercraft according to claim 1, wherein the deck fin includes the inner side wall protruding upward on an inner side in a rightward and leftward direction and facing the standing deck, and the outer side wall protruding upward on an outer side in the rightward and leftward direction, and wherein each of the inner side wall and the outer side wall is inclined to a left or a right as the inner side wall and the outer side wall extend in an upward direction, and the inner side wall is inclined at a smaller angle in the rightward and leftward direction than the outer side wall is.

3. The stand-up type personal watercraft according to claim 2, wherein the second exhaust pipe is made closer to the inner surface of the inner side wall of one of the pair of deck fins rather than the inner surface of the outer side wall.

4. A stand-up type personal watercraft comprising:

a body including a deck and a hull;

a standing deck which is provided at a rear part of the deck and on which a rider stands;

a pair of deck fins located on a left side and a right side of the standing deck, respectively, protruding upward, and extending in a forward and rearward direction, one of the pair of deck fins having an inner space which is surrounded by an inner surface of an inner side wall and an inner surface of an outer side wall and accommodates a second exhaust pipe therein; and a clamp member which is provided on an outer side of an upstream end portion of the second exhaust pipe and retains a state in which the upstream end portion of the second exhaust pipe is connected to a first exhaust pipe extending from an engine, wherein the second exhaust pipe extends in the forward and rearward direction in such a manner that the second exhaust pipe has a convex shape curving upward, and the upstream end portion of the second exhaust pipe and the clamp member are located in front of and below a top point of the second exhaust pipe.

* * * * *